United States Patent [19]

Sakulevich et al.

[11] 4,211,041

[45] Jul. 8, 1980

[54] ROTOR-TYPE MACHINE FOR ABRASIVE MACHINING OF PARTS WITH FERROMAGNETIC ABRASIVE POWDERS IN MAGNETIC FIELD

[76] Inventors: Faddei J. Sakulevich, pereulok Dalny, 3; Lev N. Kravchenko, ulitsa Kalinovskogo, 72, kv. 17; Lev M. Kozhuro, ulitsa Instrumentalnaya, 4, kv. 33; Vladimir A. Shimansky, ulitsa Knorina, 10a, kv. 19, all of Minsk, U.S.S.R.

[21] Appl. No.: 916,256

[22] Filed: Jun. 16, 1978

[51] Int. Cl.[2] ..... B24B 7/04

[52] U.S. Cl. ..... 51/131.3; 51/7; 51/161

[58] Field of Search ..... 51/109, 129, 131 R, 51/161, 7

[56] References Cited

FOREIGN PATENT DOCUMENTS 488692 1/1976 U.S.S.R. ..... 51/161

508389 5/1976 U.S.S.R. ..... 51/161

*Primary Examiner*—Harold D. Whitehead

*Attorney, Agent, or Firm*—Fleit & Jabobson

[57] ABSTRACT

A rotor-type machine comprises two electromagnetic systems, one having an inductor and, the other one, a rotor installed rotatably around its axis. Said inductor and rotor have the same and even number of alternating-polarity poles. The distance between the adjacent poles is greater than the size of the air gap. The rotor is linked kinematically with a workpiece which is located in the air gap formed by the counteropposed poles of the inductor and rotor and filled with a ferromagnetic abrasive powder which creates a cutting "brush" on the poles of one of said magnetic systems. The face surface of the poles corresponds to the profile of the workpiece surface being machined. The coils of said electromagnetic systems are connected with a power pack. The inductor is installed rotatably around its axis. Each workpiece is secured on the pole of the rotor provided with a drive for rotating it around its axis. The rotor-type machine incorporates a control unit connected to the power pack and connected, by a "direct" electric connection, with the coils of the inductor magnetic system and, by a "feedback" electric connection, with the coils of the rotor magnetic system in such a manner that each pair of counteropposed poles has a different polarity in the course of workpiece machining.

2 Claims, 4 Drawing Figures

ROTOR-TYPE MACHINE FOR ABRASIVE MACHINING OF PARTS WITH FERROMAGNETIC ABRASIVE POWDERS IN MAGNETIC FIELD

The present invention relates to machines for abrasive finishing of parts, and more specifically it relates to the rotor-type machines for abrasive machining of the surfaces of parts with ferromagnetic abrasive powders in a magnetic field.

The present invention will render most efficient service for finishing both soft ferromagnetic materials and alloys and such nonmagnetic metals as silver, aluminium, copper, etc., and for finishing hard-to-work materials such as titanium alloys, silicon semiconductor alloys, optical glass, etc.

At present, the methods of finishing the surfaces of parts in electronic devices, medical tools and turbine blades fail to ensure the adequate surface finish and a high efficiency of machining.

The attempts at increasing the output and improving the quality of the machined surfaces have resulted in the invention of a rotor-type machine for abrasive three-dimensional polishing of stomatologic shank-type tools with ferromagnetic abrasive powders in a magnetic field (Author's Certificate No. 403537, USSR). The known machine comprises an electromagnetic system formed by pairs of electromagnets facing each other with opposite poles, and arranged with an air gap between them for containing a ferromagnetic abrasive powder. The pairs of electromagnets are arranged so that the air gap has a circular shape. Located opposite to the electromagnetic system is a rotor carrying spindles which are equispaced around the circumference of the rotor, and which hold the workpieces, the latter being capable of moving along the air gap of the electromagnetic system in the course of rotation of the rotor. The rotor is provided with a drive for rotating it while the spindles have drives for rotating and oscillating them.

The air gap of the electromagnetic system contains a ferromagnetic abrasive powder which forms a "cutting brush" when the electromagnetic system is energized. Moving along the gap, simultaneously rotating around its axis, and performing an oscillating motion, the workpiece is embraced along the entire machined surface by the cutting "brush" and is thus polished.

The prior art rotor-type machine is suitable for polishing the surfaces of shank-type parts only. In the working gap of the prior art rotor-type machine, limited by the surface of the machined part and the pole, the largest axes of the grains of the ferromagnetic abrasive powder are oriented along the magnetic lines of force so that the sharp edges of the powder grains are directed towards the machined surface of the shank-type tool, said edges scratching microscopically the machined surface and ensuring its oriented cutting.

If the machined surface of a part is flat, it will be abraded by any side faces of the powder grains because, in this case, the grains of the cutting "brush" will be oriented in such a way that the workpiece surface will not be cut by the sharp edges of the abrasive powder because there will be no process of oriented cutting. The process of machining will be low productive and will fail to ensure the adequate uniformity of machining and the required quality of the machined surface.

Besides, the prior art rotor-type machine is incapable of polishing comparatively large parts due to the limited dimensions of the air gap between the opposite poles of the pairs of electromagnets constituting the magnetic system. The size of the circular air gap is limited by the required intensity of magnetic induction in the working gap. In a large air gap, the magnetic indication will be weak, thus impairing the stiffness of the cutting "brush" in the working gap and resulting in a low efficiency of polishing and a poor quality of the machined surface. In addition, an increase in the dimensions of the circular air gap required for machining large parts calls for a considerable increase in the dimensions of the machine and, consequently, for considerably larger production floor areas.

The above considerations have led to the evolution of a rotor-type machine for abrasive machining of flat surfaces of parts and of semispherical surfaces with ferromagnetic abrasive powders in a magnetic field (Author's Certificate No. 500044, USSR).

The prior art machine comprises magnetic systems, one of which has the form of a rotor carrying an even number of alternating-polarity poles, while the other one is formed by a fixed inductor with an even number of alternating-polarity poles, the pole shoes corresponding in shape to the profile of the surface being machined.

The rotor poles are arranged opposite to the inductor poles. The air gap between the rotor and inductor poles is filled with a ferromagnetic abrasive powder which forms a cutting "brush" on the inductor poles after the electromagnetic systems are connected to the power pack. The workpiece is secured on the rotor poles; it forms a working gap between its machined surface and the inductor poles, and is linked kinematically with the rotor which has a drive for rotating it around its axis. Rotating together with the rotor, the workpiece is embraced by the cutting "brush" over the entire surface to be polished.

In the prior art machine both the opposite and same polarities of the magnetic field are created at each given moment of time in the air gap formed by the counteropposed poles of the rotor and inductor. As a result, the ferromagnetic powder is arranged irregularly in the working gap.

The cutting "brush" is formed in the zone of the counteropposed poles of the rotor and inductor with opposite polarities whereas, in the zone of these poles with the same polarity, such a brush is nonexistent. Thus, at any given moment of time, not the entire surface of the part, but only its portions located under the cutting "brush", are being machined.

The above-mentioned factors affect adversely the uniformity of machining of the entire surface of the part and reduce the machining efficiency.

In view of the fact that the rotor of the known machine has an even but different number of poles, each pole of the fixed inductor faces three rotor poles. As a result, at any given moment of time, each inductor pole of a certain polarity faces two rotor poles of the same polarity and one pole of an opposite polarity; thus, the process of machining is performed only in one zone with an opposite polarity where the cutting "brush" is formed. At the best, each pole of the inductor of a certain polarity faces a rotor pole of the same polarity and two rotor poles of the opposite polarity whose zone forms a cutting "brush".

This also exerts an adverse effect on the uniformity of machining of the entire surface of the workpiece and on the machining efficiency.

The magnetic system of the inductor in the prior art machine is immovable, and this impairs the uniform distribution of the ferromagnetic abrasive powder in the working gap and fails to produce a complex network of the signs left by machining. Besides, the immovable magnetic system of the inductor limits the mixing of the ferromagnetic abrasive powder which is vital for "self-sharpening" of the cutting "brush", i.e., for the development of new cutting edges and oriented cutting.

All these factors impair the uniformity, stability and efficiency of machining and the surface finish of the machined part.

An object of the present invention resides in stepping up the output of the rotor-type machine while, at the same time, ensuring a high surface finish, uniformity and stability of machining.

In accordance with this and other objects, the substance of the present invention resides in providing a rotor-type machine for abrasive machining of the surfaces of parts with ferromagnetic abrasive powders in a magnetic field, comprising two electromagnetic systems, one of which consists of an inductor with an even number of alternating-polarity poles, while the other one includes a rotor capable of rotating around its axis, having an even number of alternating-polarity poles, and linked kinematically with a workpiece located in an air gap formed by the counteropposed poles of the inductor and rotor and filled with a ferromagnetic abrasive powder which creates a "cutting brush" on the poles of one of the magnetic systems, the face surface of the poles corresponding to the profile of the surface being machined, and a power pack connected with the coils of the electromagnetic systems wherein, according to the invention, the inductor and the rotor have an identical number of poles, the distance between the adjacent poles is larger than the size of the air gap, the inductor is installed rotatably around its axis, and each workpiece is secured on the pole of the rotor which is provided with a drive rotating it around its axis, and there is a control unit connected to a power pack and connected, by a "direct" electric connection, with the coils of the inductor magnetic system and, by an electric "feedback" connection, with the coils of the rotor magnetic system, so that each pair of the counteropposed poles has opposite polarities in the course of workpiece machining.

In the present invention, the magnetic systems of the inductor and rotor have an identical number of poles. It is vital for each inductor pole to face only one rotor pole, the distance between them being smaller than that between the adjacent poles which, in turn, is necessary for closing of the magnetic field lines of force over a shortest path between the counteropposed poles of the inductor and rotor due to a reduction of the magnetic resistance in the gap between the counteropposed poles and an increase in the magnetic resistance between the adjacent poles which reduces the losses of the magnetic field for stray fluxes.

This ensures a maximum magnetic induction in the working gap and a highly-efficient process of oriented cutting.

In the rotor-type machine according to the present invention the inductor system is installed rotatably, and this contributes to a uniform distribution of the ferromagnetic abrasive powder in the working gap and to its intensive mixing, which is essential for the development of new cutting edges in the "brush", i.e., for its "self-sharpening" and for a highly-efficient process of machining.

In the machine according to the invention, each rotor pole carrying the workpiece has a drive for rotating it around its own axis, which provides for uniform machining of the entire surface of the part and a certain optimum trajectory of the machining signs on the machined surface which is vital for producing good macro- and microgeometry of the surface.

Besides, the machine incorporates a control unit connected with a power pack and linked, by a "direct" electric connection, with the coils of the inductor magnetic system and, by a "feedback" electric connection, with the coils of the rotor magnetic system. This makes it possible at any given moment of time to obtain an opposite polarity of the magnetic field in any pair of the counteropposed poles of the inductor and rotor, said field forming the cutting "brush", i.e., an oriented cutting throughout the working zone at each given moment of workpiece machining. All these factors taken together ensure high efficiency of machining and a good surface finish of the workpiece.

It is essential that the rotation speed of the rotor should be 1.2–1.5 times higher than that of the inductor, and that the vector of rotor rotation speed should be opposite to the vector of the inductor speed of rotation. This requirement is necessitated by the fact that, at the lower rotation speed of the inductor together with the cutting "brush", the ferromagnetic abrasive powder is not thrown out of the working gap by the centrifugal force. Besides, the required speed of displacement of the cutting "brush" relative to the machined surface of the workpiece represents a summary speed of rotation of both the rotor and inductor, and ensures the required network of the machining signs on the surface being machined.

When ferromagnetic abrasive powders were used in a magnetic field for abrasive machining on the given machine of semiconductor silicon parts of 100 mm dismeter, the obtained surface roughness Ra was 0.032–0.020 microns and Rz was 0.08–0.05 microns within 30 seconds from the initial surface roughness Ra=0.63–0.4 on reaching the required macrogeometry of the surface.

Other objects and advantages of the present invention will become apparent from the following description of an embodiment of a rotor-type machine for abrasive machining of flat surfaces with ferromagnetic abrasive powders in a magnetic field with reference to the accompanying drawings in which.

Figure 1:
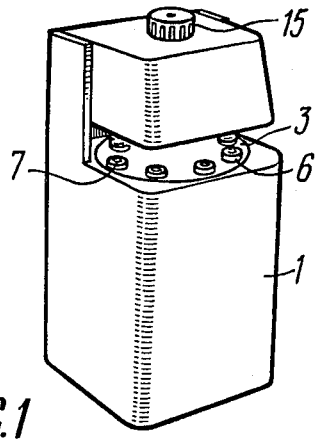
FIG. 1 is a general view of a rotor-type machine for abrasive machining of flat surfaces of parts with ferromagnetic abrasive powders in a magnetic field.

The rotor-type machine for abrasive machining of flat surfaces of parts with ferromagnetic abrasive powders in a magnetic field comprises a frame 1 (FIG. 1) in the form of a welded structure mounting the magnetic systems of the inductor 2 (FIG. 2) and rotor 3, and the drives for rotating the inductor, the rotor and its poles.

Figure 4:
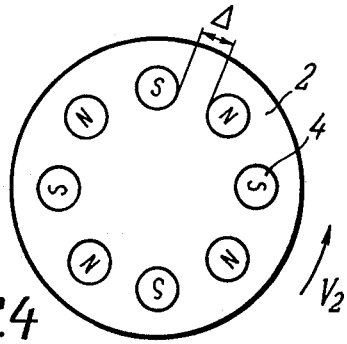
FIG. 4 is a view of the inductor along arrow B in FIG. 2.
Figure 2:
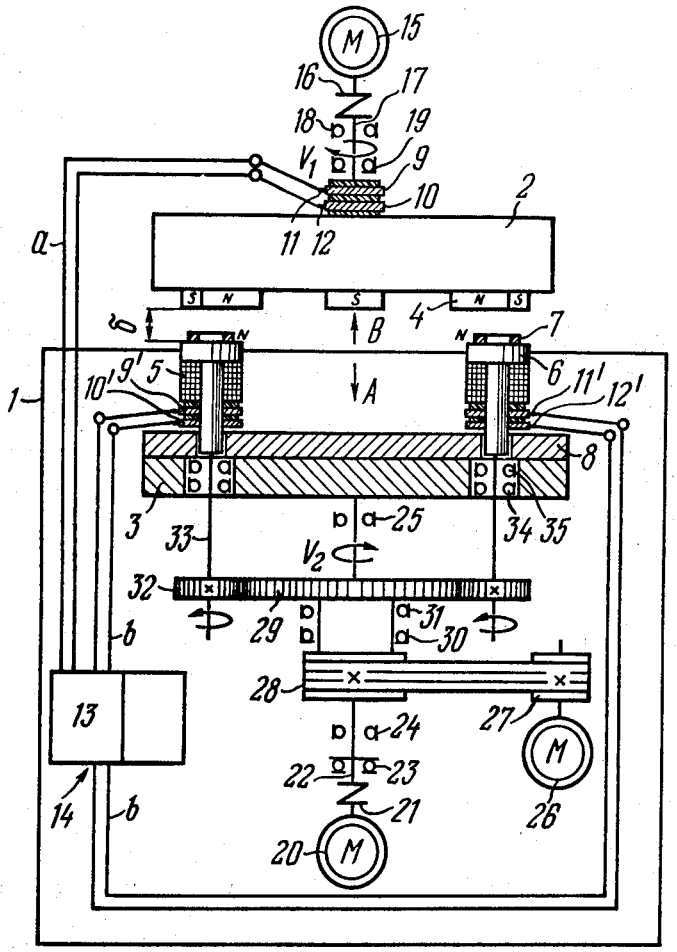
FIG. 2 is a schematic representation of a rotor-type machine for abrasive machining of flat surfaces of parts with ferromagnetic abrasive powders in a magnetic field, according to the invention.

Referring to FIGS. 2 and 4, the upper magnetic system of the inductor 2 has the form of an electromagnet with an even number of poles 4 of alternating polarity. The lower magnetic system of the rotor 3 is installed rotatably around its axis and is formed by an electromagnet with coils 5 whose poles 6 carry the workpieces 7. The poles 6 serve simultaneously as the cores of the coils 5. The electromagnetic coils 5 are equispaced around the circumference of a magnetic yoke 8 mounted on the rotor 3. The number of the electromagnetic coils 5 of the rotor 3 is equal to the number of the poles 4 of the inductor 2. This is necessary in order to position only one pole 6 of the rotor 3 opposite each pole 4 of the inductor 2.

Figure 3:
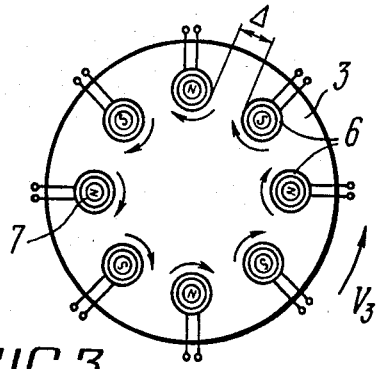
FIG. 3 is a view of the rotor along arrow A in FIG. 2.

The gap "δ" (FIG. 2) between the counteropposed poles 4 and 6 is smaller than the distance Δ (FIGS. 3 and 4) between the adjacent poles 4 or adjacent poles 6. This, in turn, is necessary for closing the lines of force of the magnetic field along the shortest path between the counteropposed poles of the inductor 2 and rotor 3 due to a reduction of the magnetic resistance in the gap between the counteropposed poles 4 and 6 and an increase of the magnetic resistance between the adjacent poles which reduces losses of the magnetic field for stray fluxes.

This produces a maximum magnetic induction in the gap "δ" and ensures a highly efficient process of oriented cutting.

The poles 4 of the inductor 2 are located opposite the poles 6 of the rotor 3. There appears a working gap between the surface of the workpiece 7 and the poles 4 of the inductor 2, said gap being filled with a ferromagnetic abrasive powder.

The electromagnetic coils of the inductor 2 are connected by a "direct" electric connection "a" via slip rings 9,10 and brushes 11,12 with the control unit 13 which, in turn, is connected with the power pack 14. The electromagnetic coils 5 of the rotor 3 are connected by a "feedback" electric connection via the slip rings 9', 10' and brushes 11', 12' with the control unit 13 which, in turn, is connected with the power pack 14.

Such an arrangement makes it possible at any moment of time in any pair of counteropposed poles of the inductor 2 and rotor 3 to ensure an opposite polarity of the magnetic field which creates a cutting "brush", i.e. oriented cutting within the entire working zone at each given moment of workpiece machining. This ensures a high efficiency of machining and a good surface finish of the machined part.

Rotation and vertical motion of the inductor 2 is ensured by an electric motor 15 via an elastic coupling 16 and a shaft 17 installed in a radial rolling-contact bearing 18 and an angular-contact bearing 19.

Rotation of the magnetic system of the inductor 2 contributes to the uniform distribution of the ferromagnetic abrasive powder in the working gap and to its intensive mixing which is essential for the creation of new cutting edges in the "brush", i.e. for its "self-sharpening" and for ensuring a highly-productive process of machining.

The rotor 3 is rotated by an electric motor 20 via an elastic coupling 21 and a shaft 22 mounted in a thrust rolling-contact bearing 23 and in radial rolling-contact bearings 24 and 25.

The poles 6 of the rotor 3 carrying the workpieces 7 are rotared by an electric motor 26 with the aid of a V-belt transmission via pulleys 27 and 28, a central gear 29 secured on the pulley 28 and installed in a rolling-contact angular bearing 30 and a radial rolling-contact bearing 31, gears 32 and shafts 33 made of a non-magnetic material and installed in radial rolling-contact bearings 34 and 35.

Rotation of each pole 6 of the rotor 3 around its axis together with the workpiece 7 secured on it provides for uniform machining of the entire workpiece surface and ensures a certain optimum trajectory of the machining signs on the surface of the workpiece which is vital for obtaining good macro- and microgeometry of the surface.

The machine functions as follows. The coils of the inductor 2 and the coils 5 of the electromagnet of the rotor 3 are energized from the power pack 14 via the control unit 13 so that a magnetic field of a preset intensity is induced in the gap between the counteropposed pairs of poles 4 and 6 of the inductor and rotor; then the electric motor 15 is turned on and moves the inductor 2 with the poles 4 vertically to create a working gap which is selected so as to ensure optimum machining conditions; besides, it starts rotating the inductor 2 via the coupling 16 and shaft 17.

The electric motor 20 starts rotating the rotor 3 via the coupling 21 and shaft 22 together with the poles 6 and the workpieces 7 which, in turn, are rotated around their axes by the electric motor 26 via the pulleys 27 and 28 of the V-belt transmission, the central gear 29, gears 32 and shafts 33 so that the workpiece performs a complex plane motion, i.e. rotation around its axis and around the circumference.

The inductor 2 and rotor 3 rotate at different speeds.

Let us designate the inductor and rotor rotation speeds as $V_2$ and $V_3$, $V_3$ being greater than $V_2$ in order to produce the required network of the machining signs on the machined surface and to rule out the throwing out of the cutting powder grains from the working gap, the rotation speed vector of the rotor 3 being opposite to that of the inductor 2.

On energizing the coils of the inductor 2 and the coils 5 of the electromagnet of the rotor 3 there appears a magnetic field in the working gap where the cutting particles (powder grains) are oriented by their larger axes along the magnetic lines of force and their sharp edges are pressed against the surface being machined.

During the relative motion of the inductor 2 and poles 6 of the electromagnet of the rotor 3 the cutting particles machine the surface of the workpieces 7.

Rotation of the inductor 2 and rotor 3 is accompanied by a constant alternation of the polarity of the inductor poles 4 and by the changing of the polarity of the rotor electromagnet poles 6 in such a way that each counteropposed pair of inductor and rotor poles 4 and 6 would have a different polarity (N-S or S-N) which improves the efficiency of machining and the surface finish of flat surfaces.

The polarity of the poles 6 of the electromagnet of the rotor 3 is changed in synchronism with the polarity changes of the poles 4 of the inductor 2 with the aid of the control unit 13.

It is obvious that the embodiments of the present invention described hereinabove are merely illustrative and that other modifications and adaptations thereof may be made without departing from the scope of the appended claims.

What we claim is:

1. A rotor-type machine for abrasive machining of the surfaces of parts with ferromagnetic abrasive powders in a magnetic field created by two electromagnetic systems, comprising: an inductor constituting one of said two electromagnetic systems, having an even number of alternating-polarity poles and installed rotatably around its axis to define a first rotation plane; the coils of said inductor installed on its poles; a rotor constituting the other one of said two electromagnetic systems, installed rotatably around its axis so as to define a second rotation plane parallel to but displaced from said first rotation plane, and having an even number of alternating-polarity poles which is equal to the number of poles of said inductor, the poles of said inductor and said rotor being counteropposed to one another to define an air gap therebetween; the coils of said rotor being installed on its poles; a workpiece secured on the pole of said rotor and located in the air gap between the counteropposed poles of said inductor and said rotor, and filled with a magnetic abrasive powder which creates a cutting "brush" on the poles of said inductor; said poles having a face surface corresponding to the profile of the surface being machined, the distance between the adjacent poles being greater than the size of the air gap; a power pack connected with said coils of said inductor and rotor; a drive intended to rotate each pole of said rotor around its axis; a control unit connected to said power pack and coupled with said coils of said inductor and with said coils of said rotor for controlling said coils so as to ensure that each pair of the counteropposed poles has a different polarity in the course of workpiece machining.

2. A rotor-type machine according to claim 1 wherein the rotation speed of the rotor is 1.2–1.5 times higher than that of the inductor, the vector of the rotation speed of said rotor being opposite to the rotation speed vector of said inductor.

* * * * *